US008044312B2

(12) United States Patent
Orban et al.

(10) Patent No.: US 8,044,312 B2
(45) Date of Patent: Oct. 25, 2011

(54) ELECTRICAL SERVICE DEVICE WITH DEPRESSIONS FOR INCREASING AIR GAPS AND LEAKAGE PATHS

(75) Inventors: Alexander Orban, Weinheim (DE); Richard Kommert, Heidelberg (DE); Matthias Bitz, St. Leon-Rot (DE)

(73) Assignee: ABB Patent GmbH, Ladenburg (DE)

( * ) Notice: Subject to any disclaimer, the term of this patent is extended or adjusted under 35 U.S.C. 154(b) by 602 days.

(21) Appl. No.: 11/661,598

(22) PCT Filed: Aug. 11, 2005

(86) PCT No.: PCT/EP2005/008704

§ 371 (c)(1),
(2), (4) Date: Jun. 17, 2009

(87) PCT Pub. No.: WO2006/024378

PCT Pub. Date: Mar. 9, 2006

(65) Prior Publication Data

US 2009/0260964 A1 Oct. 22, 2009

(30) Foreign Application Priority Data

Sep. 2, 2004 (DE) ..... 10 2004 042 427

(51) Int. Cl.
*H01H 9/02* (2006.01)

(52) U.S. Cl. ..... 200/304

(58) Field of Classification Search ..... 200/307, 200/50.32, 50.35, 304, 305, 293; 335/160, 335/202

See application file for complete search history.

(56) References Cited

U.S. PATENT DOCUMENTS

| | | | | |
|---|---|---|---|---|
| 3,289,049 | A | 11/1966 | Middendorg | |
| 4,958,135 | A * | 9/1990 | Baginski et al. | 335/8 |
| 5,001,315 | A * | 3/1991 | Runyan et al. | 200/307 |
| 2001/0006857 | A1 | 7/2001 | Eppe et al. | |
| 2004/0032702 | A1 | 2/2004 | Gibson et al. | |

FOREIGN PATENT DOCUMENTS

| | | | |
|---|---|---|---|
| DE | 43 37 254 | A1 | 5/1995 |
| EP | 1 100 104 | A1 | 5/2001 |
| FR | 2 614 132 | A | 10/1988 |

* cited by examiner

*Primary Examiner* — Edwin A. Leon

(74) *Attorney, Agent, or Firm* — Buchanan Ingersoll & Rooney PC

(57) ABSTRACT

An electrical service device having a housing is disclosed, in which voltage-carrying components are accommodated which are accessible via openings in the housing of the service device. At least one opening can have at least one wall-like insulating barrier associated with it which consists of an electrically insulating material and with which it is possible for the air gaps and leakage paths between two adjacent openings to be increased. The insulating barrier can be fixed to the housing of the service device.

19 Claims, 5 Drawing Sheets

ELECTRICAL SERVICE DEVICE WITH DEPRESSIONS FOR INCREASING AIR GAPS AND LEAKAGE PATHS

FIELD

The invention relates to an electrical service device in accordance with the precharacterizing clause of claim 1.

BACKGROUND

Electrical service devices, for example line circuit breakers, have a housing, in which the components associated with the service device, such as connection terminals, for example, which consist of an electrically conductive material and carry voltage during operation, are accommodated. The housing has openings, through which the voltage-carrying components are accessible. For example, each connection terminal has two openings associated with it: the screw of the connection terminal is actuated through one opening, and the electrical conductor to be connected is inserted through the other opening.

If a plurality of line circuit breakers are assembled, for example, to form a single device, the opposing, further openings are provided in the broad side walls, through which openings a coupling part engages which couples the components, which are associated with one another, of the two switching devices, for example moveable elements associated with the latching points of the switching mechanisms, to one another, with the result that, in the event of a tripping process in one line circuit breaker pole, the other line circuit breaker poles are also switched off.

Minimum distances, which are determined in accordance with standards valid in Europe, in relation to the air gaps and leakage paths are provided between the voltage-carrying components of the two adjacent service switching devices, which standards are not valid in other countries. For example, the specifications UL 489 prescribe markedly increased air gaps and leakage paths for all voltage levels, which air gaps and leakage paths cannot be achieved using the line circuit breakers which are at present generally marketed in Europe.

These problems naturally also apply to residual-current circuit breakers and other switching devices and their accessories.

For this reason, special production processes are required for those countries in which higher air gaps and leakage paths are required than in Europe (in particular in the Federal Republic of Germany) in order that service devices exported to the USA and marketed there meet the standards in that country.

The production of special devices, in particular the outer housing, entails higher costs owing to special tools.

SUMMARY

The object of the invention is to alter a service device of the type mentioned at the outset which adheres to the specifications in relation to certain air gaps and leakage paths such that markedly increased air gaps and leakage paths (in accordance with UL 489) can be maintained.

This object is achieved according to the invention by the features of claim 1.

According to the invention, the openings are to have at least one wall-like insulating barrier associated with them which consists of an electrically insulating material and with which it is possible for the air gaps and leakage paths between two adjacent openings to be increased; the insulating barrier is designed such that it can also be fixed retrospectively to the housing of the service device, if necessary.

As a result, electrical service devices which meet the specifications of a country can be adapted, simply by being retrofitted, to the specifications of a country which prescribe markedly increased air gaps and leakage paths.

In accordance with one particularly advantageous refinement, the insulating barrier can have a wall section which protrudes beyond the outer contour of the service device, in particular in the region of the access openings to the connection terminals.

In accordance with one development of the invention, the insulating barrier can be integrally formed, as a wall section, on a support, which engages over the opening and is matched to the contour of the installation housing at least in the region of the openings, on at least one side edge, which is located in the region of the side wall of the installation housing, the wall section running parallel to the broad side wall, and therefore the broad side wall being enlarged beyond the contour.

The wall sections can preferably be integrally formed on two edges of the support which are positioned in the region of the side walls, with the result that the wall sections act as continuations of the two side walls.

In one particularly advantageous refinement of the invention, the support together with the walls can be fixed detachably to the service device, with the result that it can be retrofitted.

If the line circuit breaker or the residual-current circuit breaker has a pedestal design, i.e. has one front and two rear facing walls and two front and two rear narrow side walls, the support in each case covers a rear facing wall and the rear side wall adjoining it.

In this case, the support can be matched, approximately in the form of an L, to the respective contour of the rear facing and side walls and may have openings between the wall sections which allow access to the voltage-carrying components, for example the connection terminals. In an advantageous manner, the service device has depressions in the region of the broad sides, into which depressions the support can be inserted and can be latched therein.

In accordance with one advantageous refinement of the invention, in each case one second depression may be provided on the broad sides of each service device in the region of the rear narrow side walls and rear facing walls, which depressions are supplemented by an identical second depression on the adjacent service device to form a gap which is located between the service device, increases the air gaps and leakage paths and opens towards the rear narrow sides and rear facing walls.

These second depressions can then also protrude into the region of the front narrow side walls.

If two line circuit breaker poles are arranged next to one another in a row, the air gaps and leakage paths are then increased owing to the gaps in the region of the access openings to the connection terminals, with the result that insulating barriers can possibly be used in which, at least in the region of the access openings to the connection terminals for connecting the electrical conductors, strips can be integrally formed which run at right angles to the support and are relatively low.

In each case one line circuit breaker—or else one residual-current circuit breaker—with the two supports can be assembled as a pole with other line circuit breaker poles to form a multi-pole line circuit breaker. If tripping operations now result in disconnection in one of the poles, the other poles should also switch off at the same time, which is brought about by a coupling between moving components of the adjacent line circuit breakers.

These couplings consist of an insulating material since the metallic tripping elements of the poles are at different potentials. In this case too, corresponding air gaps and leakage paths should be maintained.

The coupling part therefore has a radially protruding collar, whose dimensions are selected such that a minimum leakage path and air gap in accordance with UL 489 is attained.

In order that the coupling part is held optimally between the line circuit breaker poles, depressions are provided in the side walls of the line circuit breaker poles, into which depressions the collar fits and which depressions are dimensioned in terms of their lateral extent such that the coupling part with the collar can move and slide therein.

A further point at which leakage currents may occur is formed by the connecting elements for the latching connection of two service devices which are positioned with their broad sides opposite one another. If, for example, an auxiliary switch is intended to be arranged in a row with a line circuit breaker and is intended to be fixed thereto, connecting elements are used which are in the form of spreading connectors, in which case they have such dimensions that the corresponding leakage paths in accordance with UL 489 are maintained.

Further advantageous refinements and improvements of the invention can be gleaned from the further dependent claims.

DESCRIPTION OF THE DRAWINGS

The invention and further advantageous refinements and improvements and further advantages will be explained and described in more detail with reference to the drawings, in which an exemplary embodiment of the invention is illustrated and in which.

DETAILED DESCRIPTION

Figure 1:
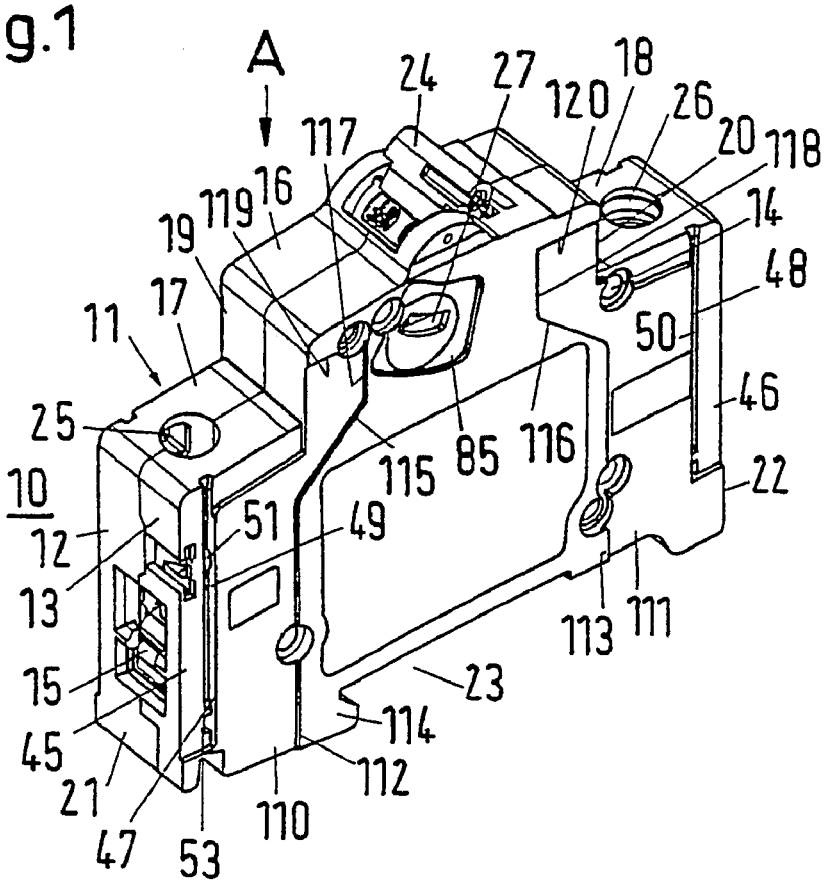
FIG. 1 shows a perspective view of a line circuit breaker, which is designed, in particular, in accordance with the European standard.

Reference will now be made to FIG. 1. The line circuit breaker 10 shown therein is a single-pole line circuit breaker, whose outer contour corresponds to the outer contour of the line circuit breaker S2 by ABB Stotz-Kontakt GmbH, Heidelberg. This line circuit breaker has a housing 11, which comprises two housing half-shells 12 and 13, which are placed opposite one another and, in this case, are connected to one another by means of riveted joints 14, of which only one is denoted by a reference numeral. Voltage-carrying electrical components, such as connection terminals 15, for example, are located within the housing 11. The housing 11 has a pedestal design having a front facing wall 16, two rear facing walls 17 and 18 and two front narrow side walls 19, 20 and two rear narrow side walls 21, 22; the front narrow side walls 19, 20 connect the front facing wall 16 to the rear facing walls 17, 18, which are then adjoined by the rear narrow side walls 21 and 22. Furthermore, the line circuit breaker also has a fixing wall 23, with which it can be fitted to a top-hat rail. A toggle switch 24 for actuating the line circuit breaker 10 protrudes out of the front facing wall 16.

A further connection terminal, which is accessible via an opening in the narrow side wall 22, corresponds to the connection terminal 15. Through-openings 25, 26 are located in the rear facing walls 17, 18, through which through-openings a screwdriver can be inserted in order to be able to actuate the clamping screws located on the connection terminals 15.

In this regard, this line circuit breaker can be regarded at least as a conventional line circuit breaker on the European market.

If two line circuit breakers are arranged next to one another, so-called leakage paths and air gaps are located between the connection terminals 15 of the two adjacent line circuit breakers, which leakage paths and air gaps should not fall below a certain minimum distance. In the same manner, leakage paths and air gaps are provided between the clamping screws of the adjacent line circuit breakers via the opening 25.

With the line circuit breaker 10, a number of poles which corresponds to the number of phases are arranged next to one another when the intention is to produce multi-pole line circuit breakers. In this case, a coupling is to be arranged between the individual poles, see FIGS. 6 and 7, which coupling passes through an opening 27 in the broad side. UL 493 also demands that certain air gaps and leakage paths are maintained in this region.

Figure 3:
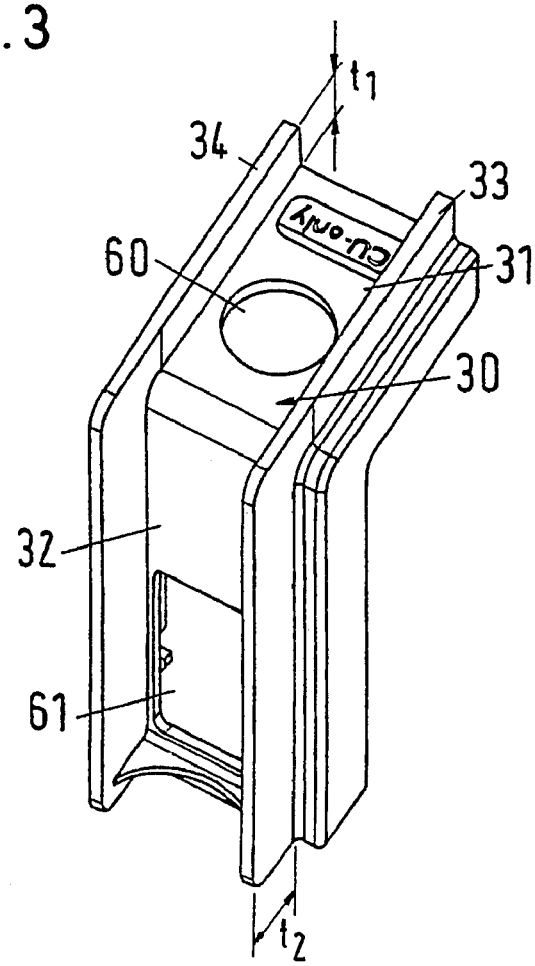
FIG. 3 shows a perspective view of an insulating barrier, from the outside.
Figure 4:
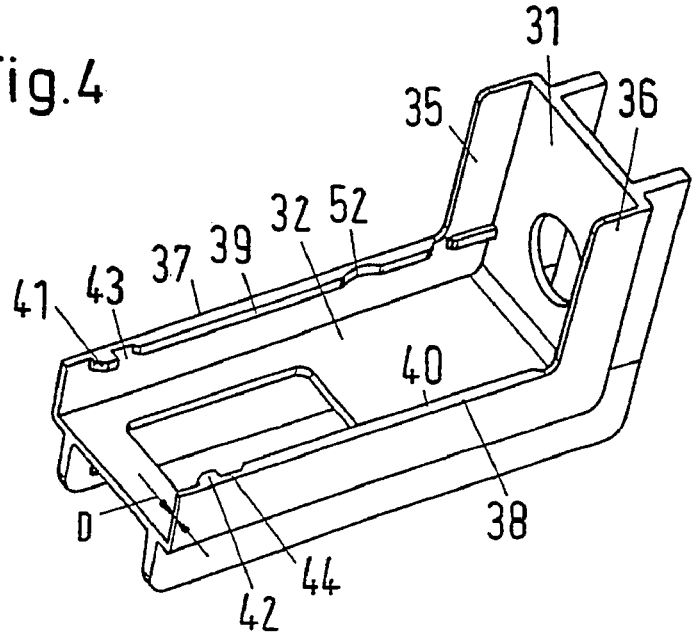
FIG. 4 shows a perspective view of the insulating barrier shown in FIG. 3, from the opposite side.
Figure 5:
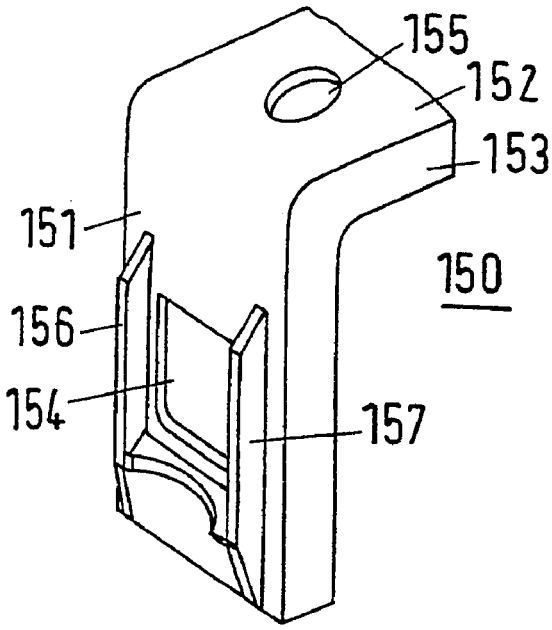
FIG. 5 shows a perspective view of a further refinement of an insulating barrier.
Figure 6:
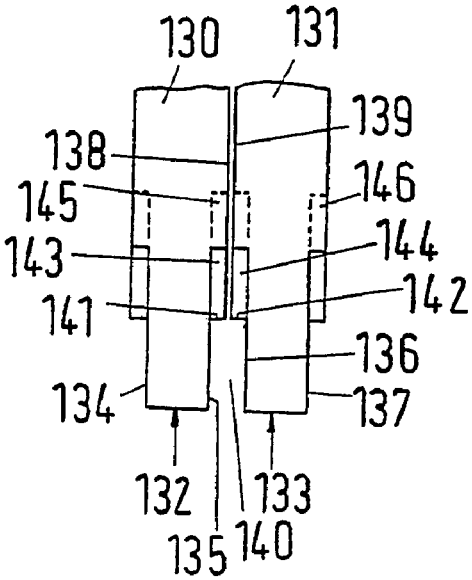
FIG. 6 shows an illustration which shows a gap formation for the purpose of increasing the air gaps and leakage paths.
Figure 7:
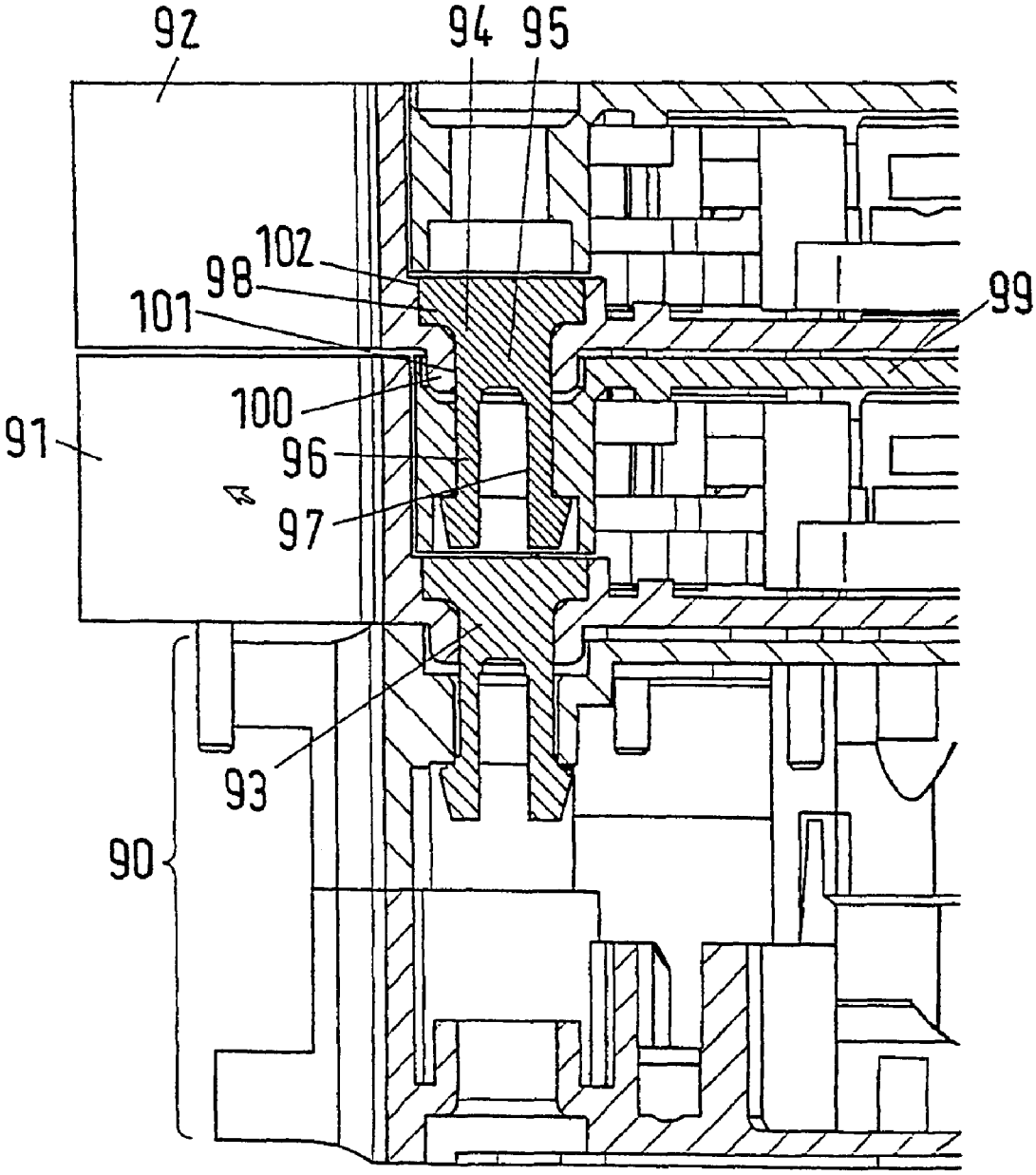
FIG. 7 shows a sectional view through a line circuit breaker having auxiliary switches connected thereto.

In order to adapt the switching device to standards which require increased air gaps and leakage paths, insulating barriers are provided which are illustrated, on the one hand, in FIGS. 3 and 4 and, on the other hand, in FIGS. 5 and 6 and 7.

Reference is now made to FIG. 3.

FIG. 3 shows an insulating barrier having an L-shaped support 30, which is matched to the outer contour of the rear narrow side walls 17 and the associated rear facing walls. The support therefore has a first limb 31, which is adjoined by a second limb 32; depending on the angular profile of the rear facing sides 17, 18 in relation to the fixing plane, the two limbs 31, 32 can be arranged at right angles or at a slightly obtuse angle with respect to one another. Wall sections 33, 34, which run at right angles to the support, are integrally formed on the outer side of the L shape of the support 30; the height $T_1$ on the limb 31 is smaller than the height $T_2$ on the limb 32, which can be attributed to the fact that the distance between the rear faces 17, 18 and the clamping screw is greater than the distance between the rear side walls 21, 22 and the connection terminal 15. The design with different heights $T_1$, $T_2$ is not essential; it is of course possible for the heights $T_1$ and $T_2$ to be the same or only approximately the same. Depending on the design of the line circuit breaker (or in more general terms: of the service device) $T_2>T_1$ could be the case. In the fitted state, the side walls run parallel to the broad side faces of the line circuit breaker 10.

Strips 35, 36, whose end edges run parallel to the inner face of the limbs 31 and 32, are integrally formed on the side edges of the inner face of the support 30, i.e. the limbs 31, 32; webs 39, 40, which are directed inwards, i.e. towards one another, and merge with latching tabs 41, 42 in the region of the free end, are integrally formed on the end edges 37 and 38 of the strips 35, 36 only in the region of the limb 32, in each case a notch 43, 44 being provided between the webs 39, 40 and the latching tab 41, 42.

The walls 35, 36 are outside the planes covered by the walls 33, 34.

The broad sides of the switching device 10 have first depressions 45, 46, also referred to as recesses 45, 46, which open out into the rear narrow side walls 21, 22 and into the rear facing sides 17, 18. A groove 49, 50 is introduced into the step 47, 48 of the depression 45, 46, it being possible for the webs 39, 40 to be inserted into said groove; an elevation 51 in the form of a cylinder arc (this is not illustrated in the groove 48) is located in the groove 49, and a corresponding cutout 52 in the web 49 corresponds to this elevation. This elevation 51 is used for fixing the barrier 30. The latching tabs 41 and 42 can engage in further cutouts 53 once they have been inserted.

Figure 2:
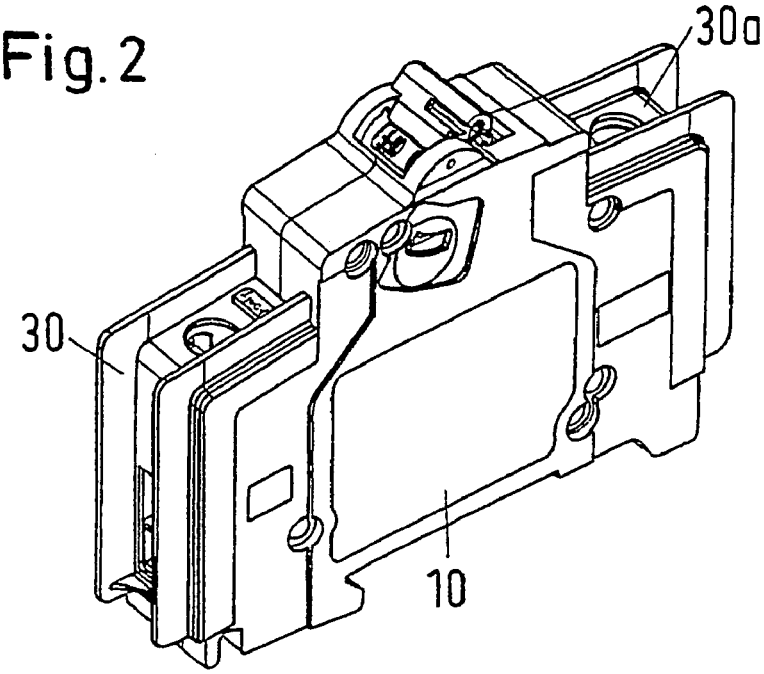
FIG. 2 shows a line circuit breaker which is based on that in FIG. 1, with insulating barriers fitted.

FIG. 2 shows the assignment of the line circuit breaker 10 to the barrier 30 and a further barrier 30*a*, which is inserted via the rear facing wall 18 and the lower narrow side wall 22.

The thickness D of the walls 35, 36 corresponds to the depth of the recesses 45, 46, with the result that, in the fitted state, the outer faces of the walls 35, 36 are aligned with the broad sides of the line circuit breaker.

The depressions 45 and 46 with the grooves 47 and 48 are naturally also located on the opposite broad side.

Openings 60, 61, which correspond to the openings 25 and 15, are located in the limbs 31 and 32; the openings 25, 26; 15 therefore ensure access to the connection terminals.

Reference is again made to FIG. 1. Second depressions 110, 111, which merge with the broad side face 114 via a step 112 and 113, are located in the region of the rear narrow side walls 21, 22 and in the region of the front narrow side walls 17, 18. The steps 112 and 113 extend parallel to the rear narrow side walls 21, 22 up to shortly in front of the rear facing wall 17 or 18 and then run over a beveled section 115 and 116 in the direction of the central plane of the switching device 10, which is formed by the plane through which the pivot point of the toggle switch runs and which is aligned at right angles with respect to the fixing plane of the service switch. A step section 117, 118 adjoins this angled face, runs again parallel to the front narrow side faces 19, 20 and merges with a step 119, 120, which runs at right angles with respect to the front narrow side wall 19 or 20 at a certain distance parallel to the front face. The depression 110, 111 therefore extends in each case up to just below the front face.

FIG. 6 shows a plan view of two adjacent line circuit breakers 130, 131, which are equivalent to the line circuit breaker 10 without the insulating barrier 30, 30*a*. Starting from the narrow side walls 132 and 133, depressions 134, 135 and 136, 137 are provided which correspond to the depressions 110, 111. When the two line circuit breakers 130, 131 are arranged next to one another, the broad side faces 138 and 139, which correspond to the broad side faces 114 in FIG. 1, lie one on top of the other, and the second depressions 135 and 136 form between them a gap 140, whose depth, starting from the rear narrow side walls and the rear facing walls, is defined by the extent of the steps 141, 142; 143, 144; 145, 146 and is dimensioned such that at least the leakage path between the access openings to the connection terminals in the rear narrow side walls 132 and 133 and furthermore also the air gap remain within the standard for a specific voltage level.

An insulating barrier, which can be used here, is illustrated in a perspective view in FIG. 5. It has the reference numeral 150 and has two limbs 151 and 152 which are aligned with respect to one another in the form of an L, strips 153, which correspond to the strips 35, 36 and have webs pointing towards one another in the same manner as the webs 39, 40 (which is not visible in FIG. 5), being integrally formed on the inner side of the limbs 151 and 152. An access opening 154 to a connection terminal through which connecting conductors can be supplied to the access terminal is located in the longer limb 151, while an access hole 155 for the clamping screw is arranged in the shorter limb 152. The opening 154 corresponds to the opening 61, and the hole 155 corresponds to the opening 60. In the embodiment shown in FIG. 5, in each case one strip 156, 157, whose height is significantly smaller than the height of the strips 33 and 34, is integrally formed only on both sides of the access opening 154; an insulating barrier shown in FIG. 5 can be used in line circuit breakers 130, 131 for lower voltage levels.

Figure 8:
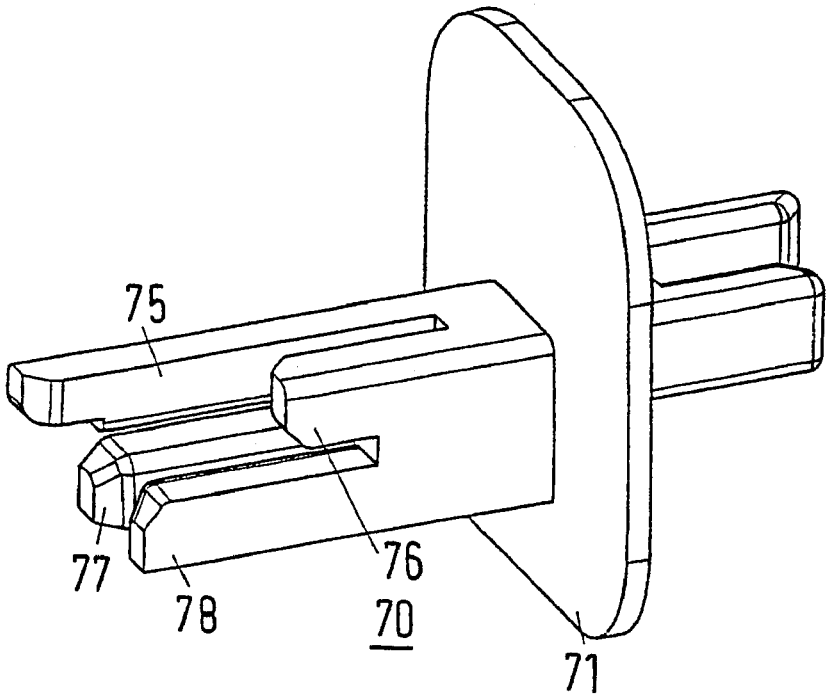
FIGS. 8 and 9 show two different perspective views of a coupling part between two line circuit breakers.
Figure 9:
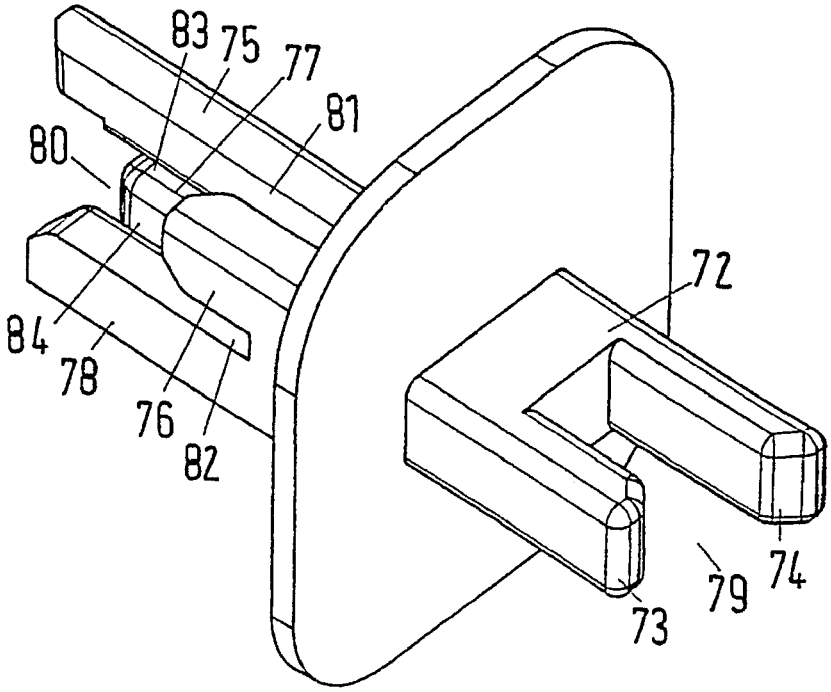

The openings 27, through which the coupling element is inserted as shown in FIGS. 8 and 9, are located in the broad sides of the line circuit breaker 10.

Reference will now be made to FIGS. 8 and 9.

The coupling part 70 described there has a central plate 71, a U-shaped protrusion 72 having two prongs 73 and 74 having a different length being integrally formed on one side of said plate at right angles with respect thereto; four prongs 75 to 78 are integrally formed at right angles thereto on the opposite side—offset with respect to the U-shaped protrusion 72. The prongs 73, 74 form an interspace 79, and the prongs 75 to 78 surround an interior 80 and have slots between them, of which only the slots 81 between the prongs 75, 76; 82, between the prongs 76, 78; 83, between the prongs 75 and 77 and 84 and between the prongs 78 and 77 can be seen in FIG. 9.

In the fitted state, the fork-like or U-shaped protrusion 72 is inserted into the interior of one line circuit breaker through the opening 27, the forks or prongs 73, 74 accommodating a moving component of a latching point for example in the switching mechanism, which is located in the interior of the housing, between them; a corresponding likewise moveable component is also located in the adjacent line circuit breaker, in which the prongs 75 to 78 engage.

The plate 71 is provided in order to extend the leakage path or the air gap running along the coupling part 70 between the two service devices. A third depression 85, into which the plate 71 fits, is provided around the opening 27 in the broad side (in each broad side), it being possible for the plate 71 also to move in this third depression.

FIG. 7 shows an arrangement next to one another in a row of a line circuit breaker 90 with auxiliary switches 91 and 92, which are both connected by means of spreading connectors 93, 94. The spreading connectors have a central basic body 95 (only the connecting element 94 is described), two axially protruding latching arms 96 and 97 being integrally formed on one side of said basic body; a cylindrical head 98 is integrally formed on the opposite side, the outer diameter of this head being markedly larger than the diameter of the basic body or the central section 95. The axial length of the head should also be dimensioned in the same way. An axially protruding collar 100, which surrounds a hole 101 which corresponds to the outer diameter of the basic body 95, is integrally formed on the housing part 99 of the auxiliary switch 92. The hole 101 expands into a depression 102, which accommodates the head 98 and whose inner diameter corresponds to the outer diameter of the head 98. The touching face between the depression 102 and the hole 101 with the outer face of the head or the outer face of the central part forms a gap, which is dimensioned such that it corresponds to the standard UL 493.

These spreading connectors have a length which is half that of the module, with the result that half-module devices can be fitted to one another.

The invention claimed is:

1. An electrical service device comprising:

a housing that includes plural openings;

voltage-carrying components located within the housing, wherein the voltage carrying components are accessible via the openings in the housing;

narrow side walls;

at least one facing wall; and broad side walls, wherein at least one of the openings has a wall-like insulating barrier, wherein the insulating barrier includes an electrically insulating material, wherein the insulating barrier is fixed to the housing of the service device, and wherein two depressions are provided on the broad side walls in the region of the openings such that, when two service devices are arranged next to one another in a row, in each case one gap is formed between the second depressions, which gap opens in each case towards the facing walls and the narrow side walls or opens out into them, with the result that the air gaps and leakage paths are increased.

2. The service device as claimed in claim 1, wherein the wall sections acting as the insulating barrier run parallel to the inner wall sections and are located within the planes covered by the inner wall sections.

3. The service device in particular as claimed in claim 1, wherein in order to connect adjacently to another service device, the service device comprises:

spreading connector elements including a basic body section and a head, which is integrally formed thereon and having a larger diameter than a diameter of the basic section, and axially running outer faces of the basic body and of the head, and a radial transition section between the head and the basic body are inserted into a correspondingly matched opening to prevent a leakage path.

4. The service device as claimed in claim 1, wherein at least one moveable, voltage-carrying part of one service device is provided with a corresponding part of another service device by means of a coupling element consisting of an insulating material, wherein the insulating barrier is a plate that is integrally formed and is aligned at right angles with respect to a longitudinal extent of the coupling part and is formed in a depression matched thereto in at least one of plural broad side faces, which lies opposite the other service device.

5. The service device as claimed in claim 1, wherein the service device is a line circuit breaker having a pedestal design and having one front and two rear facing walls and two front and rear narrow side walls, wherein the second depressions are arranged in a region of the rear facing walls and the rear narrow side walls.

6. The service device as claimed in claim 1, wherein at least one pair of the plural openings is adjacent, and wherein through the wall-like insulating barrier an air gap and leakage path between the adjacent openings is increased.

7. The service device of claim 1, wherein the housing and the insulating barrier are removably snap-fixed together via a detent mechanism.

8. The service device as claimed in claim 1, wherein the insulating barrier has a wall section which protrudes beyond the outer contour of the service device.

9. The service device as claimed in claim 8, wherein the service device is a line circuit breaker having a pedestal design and having one front and two rear facing walls and two front and rear narrow side walls, wherein in each case one support with the wall sections is fixed to the rear facing walls and the rear side walls adjoining them.

10. The service device as claimed in claim 8, wherein the wall section is integrally formed on a support, which engages over the opening and is matched to the contour of the installation housing at least in the region of the openings , on at least one side edge of the support, which side edge is located in the region of the side wall of the installation housing.

11. The service device as claimed in claim 10, wherein the wall sections are integrally formed on each edge located in the region of the side walls such that the wall sections act as continuations of the side walls.

12. The service device as claimed in claim 10, wherein the support is fixed with the wall sections on the service device in a manner suitable for retrofitting.

13. The service device claimed in claim 8, having a pedestal design and having one front and two rear facing walls and two front and rear narrow side walls, wherein in each case one support with the wall sections is fixed to the rear facing walls and the rear side walls adjoining them.

14. The service device as claimed in claim 13, having a pedestal design and having one front and two rear facing walls and two front and rear narrow side walls, wherein second depressions are arranged in the region of the rear facing walls and the rear narrow side walls.

15. The service device as claimed in claim 13, wherein each support is matched, approximately in the form of an L, to the respective contour of the rear facing walls and narrow side walls and has apertures between the wall sections, which are aligned with the openings in the housing.

16. The service device as claimed in claim 15, comprising inner wall sections provided on a side of each support which faces the service device and at least partially engage over a broad side of the service device.

17. The service device as claimed in claim 15, wherein recesses are provided on broad sides in the region of the front and rear facing and side walls, in which recesses the inner wall sections engage, with the result that the outer face of the inner wall sections and the broad side faces lie approximately in one plane.

18. The service device as claimed in claim 17, wherein in each case one groove is arranged in a recess that runs parallel to the rear narrow side walls, in which groove a web engages which is integrally formed on the end edges of the inner wall sections so as to project towards one another.

19. The service device as claimed in claim 18, comprising latching means provided on the webs and in the grooves via which latching means the support can be fixed to the service device.

* * * * *